US005576093A

United States Patent [19]

Yoshimura et al.

[11] Patent Number: 5,576,093

[45] Date of Patent: *Nov. 19, 1996

[54] MULTILAYER COATED HARD ALLOY CUTTING TOOL

[75] Inventors: Hironori Yoshimura; Tetsuya Tanaka; Akira Osada; Toshikatsu Sudo, all of Ibaraki-ken, Japan

[73] Assignee: Mitsubishi Materials Corporation, Tokyo, Japan

[ * ] Notice: The term of this patent shall not extend beyond the expiration date of Pat. No. 5,372,873.

[21] Appl. No.: 301,584

[22] Filed: Sep. 7, 1994

Related U.S. Application Data

[63] Continuation of Ser. No. 964,947, Oct. 22, 1992, Pat. No. 5,372,873.

[51] Int. Cl.[6] ..... C23C 9/00

[52] U.S. Cl. ..... 428/216; 51/307; 51/309; 428/336; 428/472; 428/697; 428/698; 428/699; 428/701; 428/702

[58] Field of Search ..... 428/216, 336, 428/472, 697, 698, 699, 701, 702; 51/307, 309; 407/119

[56] References Cited

U.S. PATENT DOCUMENTS 4,714,660 12/1987 Gates, Jr. ..... 428/699
4,746,563 5/1988 Nakano et al. ..... 428/698
4,984,940 1/1991 Bryant et al. ..... 428/698
5,250,367 10/1993 Santhanam et al. ..... 428/697

*Primary Examiner*—Archene Turner
*Attorney, Agent, or Firm*—Oblon, Spivak, McClelland, Maier & Neustadt, P.C.

[57] ABSTRACT

The present invention concerns a tungsten carbide base cutting tools formed on sintered hard alloy substrate material. Multiple hard coatings are deposited on the Co-enriched surface layers of the substrate material, and a maximum value of the Co concentration in a layer occurs within a distance of 50 μm of the external surface of the substrate material, and this surface layer region is referred to as the denuded zone because the surface region is substantially free of carbides, carbonitrides and nitrides of Ti, Ta, and Nb containing W. The multilayer coating consists of a primary coating of TiCN, a secondary coating of $Al_2O_3$ and the surface coating consisting of at least one of TiCN and TiN. The interface between the substrate material and the primary coating is provided with a first intermediate coating consisting of TiN. The interface between the primary coating and the secondary coating is provided with a second intermediate coating consisting of at least one layer of TiC, TiCO and TiCNO.

40 Claims, 4 Drawing Sheets

MULTILAYER COATED HARD ALLOY CUTTING TOOL

This is a continuation of application Ser. No. 07/964,947, filed on Oct. 22, 1992 now U.S. Pat. No. 5,372,873.

BACKGROUND OF THE INVENTION

1. Technical Field

The present invention relates to hard alloy cutting tools having a multilayer surface coatings for providing good adhesion, wear and chipping resistance.

2. Technical Background

The application of coated hard alloys for insert cutting tools (referred to as inserts hereinbelow) has been gaining popularity in recent years. For disposable inserts, the percentage of the coated tools has reached about 40% in Japan, and more than 60% in western countries.

One reason for such popularity for the coated inserts is the improvement in the toughness of the substrate materials.

It is known generally that when the surface of hard alloys is protected with a hard coating, although the wear resistance is improved, the resistance to chipping is degraded. To rectify this problem, it is essential to improve the toughness of the substrate material. However, improving the toughness often means sacrificing the hardness which provides a basis of wear resistance but is in a converse relationship to toughness.

For this reason, the past solutions for improving the toughness of coated hard alloys involved mainly the surface layer portion of the substrate material, not the substrate material itself. The concept is that if the interior (core) of the hard alloys is hard, and the surface layers of the substrate material is tough, both wear resistance and chipping resistance can be improved simultaneously.

In fact, many of the coated hard alloy inserts in the markets for cutting steels and ductile cast irons, are made so that the surface layer is high in Co and has high toughness, and the core is relatively low in Co and has high hardness.

Such materials were first disclosed in a Japanese Patent Application, First Publication, Showa52(1977)-Laid Open No. 110,209, which disclosed a coated hard alloy of improved toughness as a result of having a surface layer thickness of 10–200 μm, whose hardness is lowered by 2–20% compared with that of the core of the substrate material.

In this patent application, the first embodiment shows a substrate material of a composition, WC-10% TiC10% Co (by weight in all the subsequent cases, unless otherwise stated), coated with a slurry of WC-10% Co, dried and sintered at 1430° C. for one hour to prepare a surface layer thickness of 130 μm, Vicker's hardness of 1320 in the surface layer, and 1460 in the core. There are no TiC particles, which are brittle, in the surface layer and the volume percent of the Co phase in the surface layer is higher than that in the core. A chemical vapor deposited (CVD) TiC coating of a 6 μm thickness is provided on the Co-enriched surface layer, thereby producing a coated high toughness hard alloy.

In the second embodiment, a TiC coated hard alloy is presented in which a mixture consisting of WC-6% Co and WC-10% Co is press compacted and sintered to produce a substrate material having a surface layer thickness of 80 μm, and Vicker's hardness 1320, and a core Vicker's hardness of 1450.

In the meanwhile, a Japanese Patent Application, First Publication Showa53(1978)-131909, discloses in the claims, a coated hard alloy having a softer but tough surface layer, in which the hardness increases continuously towards the core.

In the first embodiment of the above-noted application, a method of preparing a substrate material from a powder mixture of WC-1% TiC-3% TaC-6% Co, by sintering at 1400° C. for 30 minutes in a vacuum of $2\times10^{-2}$ torr, depositing a Co surface layer of a thickness of 25 μm, and sintering at 1430° C. for 30 minutes in a 300 torr hydrogen. By such a process, a hard substrate material is obtained in which a Vicker's hardness gradient is present, from a value of 1050 at the external surface, 1260 at 15 μm depth, 1520 at 60 μm and 1540 at 500 μm depths, and having a Co concentration which decreases towards the core from the surface which consists of only Co at the depth of 1–2 μm. The surface of this substrate material is coated with a 5 μm thickness CVD TiC, to produce a coated hard alloy.

In the second embodiment of the above-noted patent application, another example which involves the steps of preparing a mixture of WC-9% TiC-10% TaC-8% Co, sintering at 1450° C. for 1 hour in a vacuum of $2\times10^{-2}$ torr, coating the surface with graphite and sintering at 1450° C. for 30 minutes, to produce a substrate material having a Vicker's hardness gradient which increases from a value of 1160 at the surface towards the core as, 1290 at 15 μm depth, 1490 at 60 μm depth and 1450 at 500 μm depth. The surface of this substrate is coated with a CVD TiN coating of a 4 μm thickness, to produce a coated hard alloy.

In a U.S. Pat. No. 4,277,283 (Japanese Patent Application, First Publication, Showa54(1979)-Laid Open No. 87,719, discloses in the claims, an example of a coated substrate material having high toughness surface layers of a 5–200 μm thickness, in which the proportion of the B-1 type hard phases, TiC, TaC and TiN containing W, in the surface layer is lower compared with that in the core.

In the first embodiment of the above-noted patent, a sintered hard metal is disclosed, produced from a powder mixture consisting of WC-4%$(Ti_{0.75}W_{0.25})(C_{0.68}N_{0.32})$-5%$(Ta_{0.75}Nb_{0.25})$C-5.5% Co, heating the mixture in a $10^{-3}$ vacuum at 1450° C. to eliminate B-1 type hard phase completely to a depth of 10 μm, so that the surface layer is virtually all WC-Co. The surface of the substrate material is coated with a 6 μm thick CVD TiC coating to produce a coated hard alloy cutting tool. The toughness of this tool is high because the surface layer becomes enriched with Co as the B-1 type hard phase is eliminated.

The second embodiment shows a substrate material made of a power mixture, WC-6.3%$(Ti_{0.75}W_{0.25})$ $(C_{0.68}N_{0.32})$-7.5%$(Ta0.75Nb_{0.25})$C-10.5% Co, which is sintered at 1380° C. in a vacuum of $10^{-3}$ torr, and depositing a 6 μm thick coating of TiC, to produce a coated hard alloy. Other examples in the above-noted patent include a substrate material of a mixture WC-4%$(Ti_{0.75}W_{0.25})(C_{0.68}N_{0.32})$-5%$(Ta_{0.75}Nb_{0.25})$C 5.5% Co, which is heated at 1450° C. in a vacuum of $10^{-3}$ to produce two types of substrate materials: a substrate in which free carbon particles are precipitated; and a substrate in which free carbon particles are not precipitated. The surfaces are coated with a 6 μm thickness coating of TiC followed by 1 μm thick $Al_2O_3$ to produce coated cutting tools. Other examples concern materials of a general composition represented by (Ti, W)(C, N) and coating the surfaces with the usual CVD TiN coating to a thickness of 6 μm.

Another U.S. Pat. No. 4,610,931, discloses hard alloy substrate materials containing no free carbon particles, and having no B-1 type phase in a surface layer (claim 1); having a Co-enriched surface and no B-1 phase in the surface layer (claim 6). These substrate materials are coated with coatings such as TiC, TiN and $Al_2O_3$ by the usual CVD method.

However, when the B-1 type phases in the surface layer are eliminated, Co enrichment occurs simultaneously in the region, therefore, these hard alloys and coated hard alloys become identical with those disclosed in Japanese Patent Application, First Publication Showa54(1979)-Laid Open No. 87719.

The above-noted U.S. Pat. No. 4,610,931, discloses further: hard alloys containing no free carbon particles in which a part of the surface is removed by grinding and heattreated again to covert the nitrides and carbonitrides in the surface layer to carbides (claim 25); Co-enriched surface hard alloy (claim 30); and above-treated and coated hard alloys (claim 32).

The first embodiment of this patent shows a material WC-10.3% TaC-5.85% TiC-0.2% NbC-8.5% Co-1.5% TiN, which is heated at 1496° C. for 30 minutes; sintered in a vacuum; made into a cutting insert after which the upper and lower surfaces (rake surfaces) are ground; heated again at 1427° C. for 60 minutes in a vacuum at 100 μm Hg, and after cooling at a given rate to 1204° C., the flank surface is ground. The surface is coated with TiC and TiN coatings using the usual CVD coating method to produce coated hard alloys having no free Carbon particles, and having a Co-enriched layer and no B-1 type phases to a depth of 22.9 μm, and coated with a multilayer consisting of 5 μm thick TiC, 3 μm thick TiCN and 1 μm thick TiN layers.

In another U.S. Pat. No. 4,830,930 (corresponding Japanese Patent Application, First Publication Showa63(1988)-Laid Open No. 169,356), which discloses in the claims, a hard alloy substrate material, in which the surface layer of 10 to 500 μm thickness contains a gradient of a binder phase (Co-containing phase) such that the binder phase concentration is maximum at the surface decreasing to a level at a depth of 5 μm towards the core.

The first embodiment of the above-noted patent discloses a method of producing a substrate material following the steps of: preparing compacts of a powder mixture of WC-5% TiC-7% Co; sintering the compacts at 1380° C. for one hour; carburizing at 1330° C. for 10 minutes in an atmosphere of a 20 torr 80% $H_2$-20% $CH_4$ mixture; decarburizing at 1310° C. for 2 minutes in an atmosphere of 10 torr 90% $H_2$-10% $CO_2$ mixture; cooling in a vacuum; thereby obtaining a microstructure having a Co content which is maximum at the surface and gradually decreases towards a core Co value. The substrate material thus prepared is coated with a CVD TiC coating of a 5 μm thickness.

Other examples include substrate materials of a composition, WC-3% TiC-3% TaC-1% NbC-5% Co, treated by the same processing steps as above, and coated with TiC/TiCN/$Al_2O_3$ coatings to provide coated hard alloys.

The foregoing extensive review of the prior art technologies is given to show that the studies are mostly concerned not with improving the coatings but with improving the toughness of the surface layer, which provided improved chipping resistance but which still left a problem of low wear resistance.

In the following section, research studies for improving the properties of the coatings will be reviewed. Representative examples are U.S. Pat. No. 4,497,874 and U.S. Pat. No. 4,812,370 (Japanese Patent Application, First Publication, Showa63(1988)-Laid Open No. 89666).

U.S. Pat. No. 4,497,874 discloses a coated hard alloy material having a Co-enriched surface on which a first coating of TiN is deposited. The reason recited for using the first layer of TiN instead of the usual coating of TiC is if TiC coating is applied directly to the Co-enriched surface layer, alloying occurs in the enriched layer. Therefore, the first TiN coating is used to prevent such alloying, and to form a thick layer of TiC directly on the TiN layer without resorting to forming a gradation layer.

In the first embodiment of the above-noted patent, a method is disclosed of preparing a substrate material of WC-6% TaC-6% Co-5%$(W_{0.5}Ti_{0.5})C$, according to the steps of: preparing pressed compacts and dewaxing at 1260° C.; heating the dewaxed compacts in a partial vacuum of 600 torr and flowing nitrogen (at 3 L/min) for 45 minutes; removing the nitrogen and raising the temperature to 1445° C. and sintering the compacts for 100 minutes; to produce a substrate material having a Co-enriched 30 μm thick surface layer in which there is no B-1 type phase. The hard alloys are produced by coating the substrate material with TiN/TiC/TiN or with $Al_2O_3$.

U.S. Pat. No. 4,812,370 (Japanese Patent Application, First Publication Shows63(1988)-89666) discloses in the claims, a coated hard alloy having a Co-enriched surface layer on which WC and a Co-diffused TiC first coating is deposited, a TiCN-TiN second coating to prevent the diffusion of WC and Co, a third coating of pure TiC, and a fourth coating, such as TiCO, TiCNO and $Al_2O_3$.

The preferred embodiments of the above-noted application disclose, a coated hard alloy material of WC-12.4%$(Ti_{0.46}Ta_{0.22}W_{0.32})(C_{0.80}N_{0.20})$-8.0% Co, having a Co-enriched surface layer of an 18 μm thickness, and having a 3 μm thick TiC coating with diffused WC and Co, a 2 μm TiCN coating, a 2 μm TiC coating and a 0.3 μm $Al_2O_3$ coating.

The foregoing technologies are aimed at solving the problems of chipping of hard alloys when a CVD coating is applied directly to the Co-enriched surface layer of a substrate material, causing the formation of undesirable microstructures such as pores and a brittle eta phase in the surface layer, due to the diffusion of WC and Co from the substrate. The TiC coatings with diffused WC and Co suffer also from poor wear resistance.

The hard alloy produced according to U.S. Pat. No. 4,497,874 still present problems such as the poor adhesion of the first coating TiN to the substrate material, and inadequate wear resistance because the primary coating is TiC. Also, the step of decarburizing disclosed (in claims 11, 12 and 15) before the first coating of TiN is applied to the substrate material, is not effective for improving the wear resistance significantly.

The technology disclosed in U.S. Pat. No. 4,812,370 (Japanese Patent Application, Showa63(1988)-89666) is also deficient in that the wear resistance is inadequate because of inter-diffusion of WC and Co from the surface layer into the first TiC coating, and because of the poor adhesion between the first coating TiC and the second coating TiCN.

To rectify such problems in the existing coated hard alloys as outlined above, the present invention presents a new technology for preparing a coated hard alloy cutting tool of high toughness and high resistance to wear and chipping, and whose Co-enriched surface layer is free of detrimental microstructures, such as pores and brittle phases (an eta phase in the embodiments). The coatings are made to adhere tightly to the substrate material by controlling the Co distribution in the Co-enriched surface layer, and by adopting a new surface coating technique.

SUMMARY OF THE INVENTION

The objective of the present invention is to present a coated hard alloy cutting tool of high toughness and high resistance to wear and chipping, in which the surface layer of the substrate material is free of pores and a brittle phase, and is adhered tightly to the coatings applied thereon.

The present invention concerns a coated hard alloy cutting tool comprising a plurality of hard coatings formed on the surfaces of a primarily WC substrate material containing Co, and consisting essentially of a core and surface layers. The concentration of Co reaches a maximum in a surface layer region up to a distance of 50 μm from the external surface, which region is substantially free of the carbides of Ti, Ta and Nb containing W; the carbonitrides of Ti, Ta and Nb containing W; and the nitrides of Ti, Ta and Nb containing W; and wherein the plurality of surface coatings consist of a primary coating of TiCN deposited on the surface layer, a secondary coating of $Al_2O_3$ deposited on the primary coating, and a surface coating consisting of at least one coating of TiCN and TiN deposited on the secondary coating of $Al_2O_3$.

The interface (which is also the external surface of the substrate material) between the substrate material and the primary coating of TiCN is provided with a first intermediate coating of TiN to lower the residual stresses in the primary coating of TiCN.

Between the primary coating and the secondary coating, a second intermediate coating, consisting of at least one layer of a TiC layer, TiCO layer or TiCNO layer, is provided so as to improve the adhesion of the coatings.

The coatings of the present invention are deposited at relatively low temperatures of deposition, and have a relatively high concentration of Co in the surface layers. Therefore, compared with the existing coated cutting tools, residual tensile stresses in the as-deposited coating layers are held relatively low, between 15–30 Kg/mm$^2$. The low residual stress level in the coatings is a reason for high chipping resistance of the cutting tools of the present invention.

The chipping resistance is improved further in the present invention by treating the as-deposited coatings so as to adjust the magnitude and type of residual stresses in the coatings. In some cases, the tensile residual stresses in the coating can be converted into compressive residual stresses. This is accomplished in the following way.

Shot peening is employed in the present invention to effectively control the magnitude and type of residual stresses in the shot peened coatings and underlying coating. By this processing, the tensile residual stress level is lowered to below 15 Kg/mm$^2$ and by varying the peening conditions, it is possible to convert tensile stresses into compressive stresses.

By impacting the surfaces of the coated alloy with steel balls thereby lowering the tensile residual stresses therein, chipping resistance of the coated alloy is increased. However, wear resistance is lowered in some cases. Therefore, it is effective to treat only the rake surfaces, and such a procedure is more economical for production purposes also. By so doing, chipping resistance of the coated alloy increases, and lowering in wear resistance becomes rare.

Other variations of the basic invention includes the following variations in the microstructure of the substrate material.

It is possible to produce a coated hard alloy cutting tool in which a core region of the surface layer between 100 μm and 400 μm distances for the external surface of the substrate material is substantially free of free carbon particles, while the free carbon particles are present in the core beyond the distance of about 400 μm into the substrate material.

In the above substrate material, it is further possible to improve the adhesion between the primary coating of TiCN and the secondary coating of $Al_2O_3$ by depositing a second intermediate coating of TiC. Other variations of the second intermediate coating of TiC are TiCO and TiCNO layers of preferably less than 1 μm thickness. The thickness of the first intermediate coating of TiN (between the substrate external surface and the primary coating TiCN) is also preferably less than 1 μm.

In the above-noted structures of cutting tools also, the residual tensile stresses in the primary coating can be made to be not more than 30 Kg/mm$^2$, and this value can be further controlled with the application of shot peening to not more than 15 Kg/mm$^2$. With further peening, it is even possible to convert the tensile residual stresses in the primary coating to compressive residual stresses, and control the value of the compressive residual stresses to be not more than 20 Kg/mm$^2$.

The shot peening process is applied locally to parts of the cutting tool, for example to the rake surfaces, so that the residual tensile stresses in the primary coating thereon are lower than those tensile residual stresses in the primary coating on the flank surfaces of the cutting tool.

Further shot peening treatment is applied so that the residual stresses in the primary coating of the rake surfaces of the cutting tool are compressive, and that the residual stresses in the primary coating of the flank surfaces are tensile.

DETAILED DESCRIPTION OF THE PREFERRED EMBODIMENTS

Basic Configurations

Figure 1:
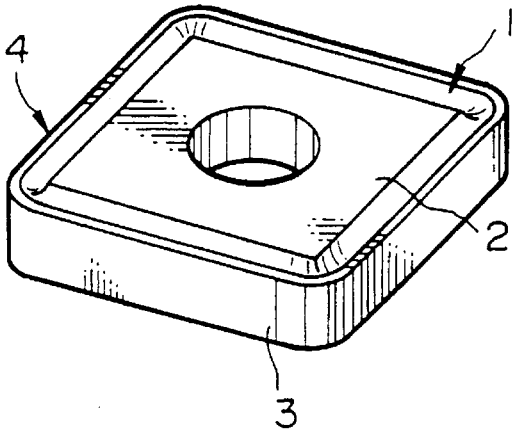
FIG. 1 is an illustration of an example of application of the present invention to making of an insert.

FIG. 1 is an example of applying the technique of preparing coated hard alloy material of the invention to an insert. A square shaped insert body 1 is provided with a rake surface 2 on the top and bottom surfaces, and the flank surfaces 3 are formed on the side surfaces thereof, forming cutting edges 4 at the intersections of the top and bottom surface with the side surfaces. The insert body 1 comprises a substrate material and various coatings to be described later.

In this embodiment, a square shape is illustrated, but the invented structural configuration is equally applicable to other shapes such as triangles, parallelepipeds, rhomboids and circles.

Figure 2:
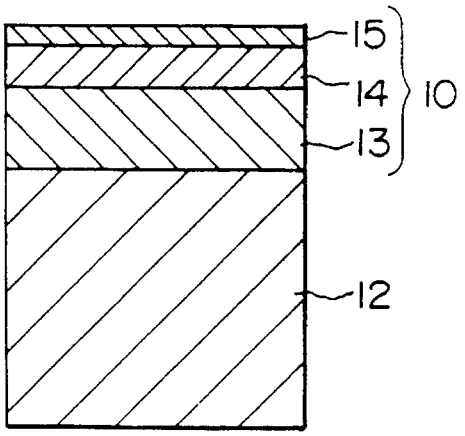
FIG. 2 is a cross sectional view of the coating configuration of a first embodiment of the insert shown in FIG. 1.

FIG. 2 is a first embodiment of the coating layer configuration of the invention. The coating layer 10 of this embodiment is formed on a substrate material 12, and consists of a primary coating 13, a secondary coating 14 and a surface coating 15.

Figure 3:
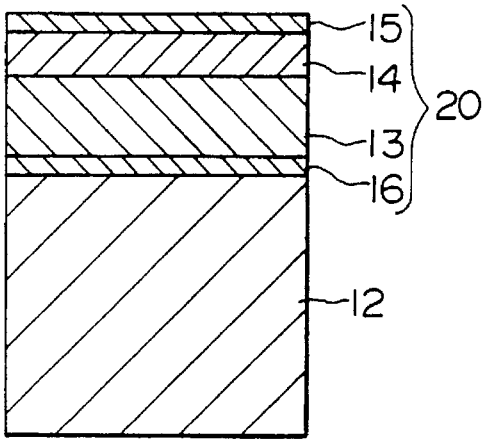
FIG. 3 is a cross sectional view of the coating configuration of a second embodiment of the insert shown in FIG. 1.

FIG. 3 is a second embodiment of the coating layer configuration of the invention. The coating layer 20 of this embodiment is formed on the external surface of the substrate material 12, and consists of a first intermediate coating 16, the primary coating 13, the secondary coating 14 and the surface coating 15.

Figure 4:
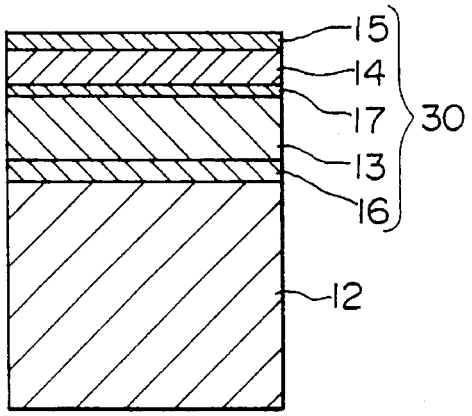
FIG. 4 is a cross sectional view of the coating configuration of a third embodiment of the insert shown in FIG. 1.

FIG. 4 is a third embodiment of the coating layer configuration of the invention. The coating layer 30 of this embodiment is formed on the external surface of the substrate material 12, and consists of a first intermediate coating 16, the primary coating 13, a second intermediate coating 17, the secondary coating 14 and the surface coating 15.

Figure 5:
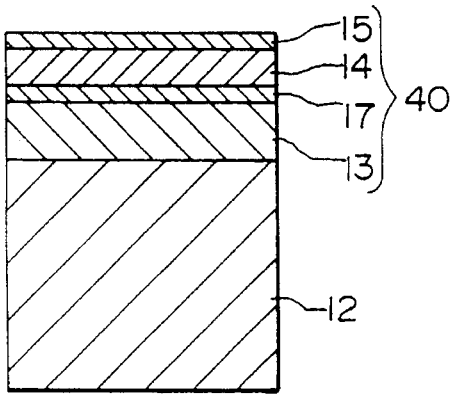
FIG. 5 is a cross sectional view of the coating configuration of a fourth embodiment of the insert shown in FIG. 1.

FIG. 5 is a forth embodiment of the coating layer configuration of the invention. The coating layer 40 of the embodiment is formed on the external surface of the substrate material 12, and consists of the primary coating 13, the second intermediate coating 17, the secondary coating 14 and the surface coating 15.

Figure 6:
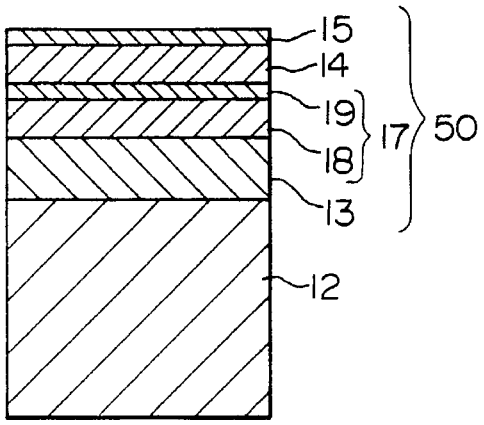
FIG. 6 is a cross sectional view of the coating configuration of a fifth embodiment of the insert shown in FIG. 1.

FIG. 6 is a fifth embodiment of the coating layer configuration of the invention. The coating layer 50 of the embodiment is formed on the external surface of the substrate material 12, and consist of the primary coating 13, the second intermediate coating 17, the secondary coating 14 and the surface coating 15. The second intermediate coating 17 consists of a primary intermediate coating 18 and a secondary intermediate coating 19.

The substrate material 12 has WC as its primary constituent, with Co added as a binder, but may contain other additives such as B-1 type hard phases comprising carbides, nitrides and carbonitrides of Ti, Ta and Nb containing W; nitrides of Ti, Ta and Nb containing W; and unavoidable impurities. However, the essential conditions are that the maximum Co concentration occurs in the surface layer (termed denuded zone) within 50 μm from the external surface of the substrate material 12, and that the B-1 type hard phases comprising carbides, nitrides and carbonitrides of Ti, Ta and Nb containing W; and nitrides of Ti, Ta and Nb containing W are substantially absent in the denuded zone.

The primary coating 13 is composed of a TiCN layer, the secondary coating 14 is composed of a $Al_2O_3$ layer, and the surface coating 15 is composed of either or both of a TiCN layer and a TiN layer. The first intermediate coating 16 is composed of a TiN layer and the second intermediate coating is composed of at least one of the layers of TiC, TiCO and TiCNO.

The procedure for preparing the substrate material 12 will be described in the following. A powder mixture corresponding to the desired composition of the substrate material 12 is prepared. This powder mixture is mixed with binders and additives, as necessary, and the mixture is ball-milled and dried to obtain a powder material. The powder material which can be used in preparing the raw material includes any one or a plurality of the elements in Group 4*a*, Group 5*a* and Group 6*a*; or carbides, nitrides and carbonitrides of Group 4*a*, Group 5*a* and Group 6*a* elements as well as other known elements or compounds generally used in hard alloy materials, such as powder materials of WC, (TiW)(CN), (TaNb)C, Co and graphite.

Next, the powder material is press compacted into green compacts, which are sintered in a reduced pressure furnace at around 1400° C. to produce a substrate material which has no free carbon particles or whose core contains free carbon particles but whose surface layer of 100–400 μm depth is substantially free of free carbon particles. In the foregoing and in what follows, the depth usually refers to a distance measured from the external surface of the substrate material or from the interface between the substrate material and the primary coating.

Free carbon is produced in the substrate material when more than the required amount (for forming the hard alloy) of graphite powder is added in the preparation of the raw powder material. The excess graphite precipitates in the substrate material as free carbon particles during the sintering process. The free carbon particles are precipitated as black particles in the body of the substrate material during sintering, but in this invention this precipitation is controlled to occur in the core at the depth of 100–400 μm, which is referred to as the core zone. In other words, the precipitation depth closest point to the surface is 100 μm, and the farthest depth is 400 μm. The precipitation is readily observable with an optical microscope.

The substrate material 12 has the denuded zone in which the carbides, nitrides and carbonitrides of Ti, Ta and Nb containing W are substantially absent. Such microstructural changes can be observed readily with an optical microscope, because the carbides, nitrides and carbonitrides of the above mentioned elements are etched black in the metallographic specimen preparation.

The surfaces of the sintered compacts are processed by such means as honing, and CVD coatings deposited at relatively low temperatures thereon to produce coated hard alloy inserts of the invention. In depositing such coatings, the residual stresses in the as-deposited coatings are tensile, whose value is less than 30 $Kg/mm^2$.

After the coatings are applied, the residual stresses in the coatings can be adjusted by means of shot peening. By adjusting the peening parameters, the residual stresses can be lowered from tensile residual stress of 30 $Kg/mm^2$ to less than 15 $Kg/mm^2$. The stress type can also be altered from a tensile to a compressive type. In practice, in the case of steel balls, the speed is in a range of 50–70 m/s, and the peening time of 60–90 seconds to obtain the range of stresses mentioned above.

First Preferred Embodiment and Processing Steps

WC powder of 3.5 μm average diameter, $(Ti_{0.71}W_{0.29})(C_{0.68}N_{0.32})$ powder of 1.5 μm average diameter, $(Ta_{0.83}Nb_{0.17})C$ powder of 1.4 μm average diameter, Co powder of 1.2 average diameter, were blended into a mixture having a composition, WC-5.9%$(Ti_{0.71}W_{0.29})(C_{0.68}N_{0.32})$-4%$(Ta_{0.83}Nb_{0.17})C$-6% Co, all by weight, to which 0.16% graphite powder was added, and the entire mixture was wet-milled for 72 hours in a ball-mill, and dried. Green pressed compacts were made in accordance with ISO CNMG120408 using a press at 15 $Kg/mm^2$. The green pressed compacts were sintered in a vacuum of $1\times10^{-2}$ torr at 1410° C. for one hour. Samples of hard alloy substrate material which is basically free of free carbon particles were thus produced.

The cutting edges were prepared by honing the surface to a depth of 0.07 mm on the rake surface and to a depth of 0.04 mm on the flank surfaces, and the coatings were applied under the conditions shown in Table 1 to produce coated hard alloy cutting insert samples 1 to 16 (hereinbelow termed samples) listed in Table 2.

Figure 7:
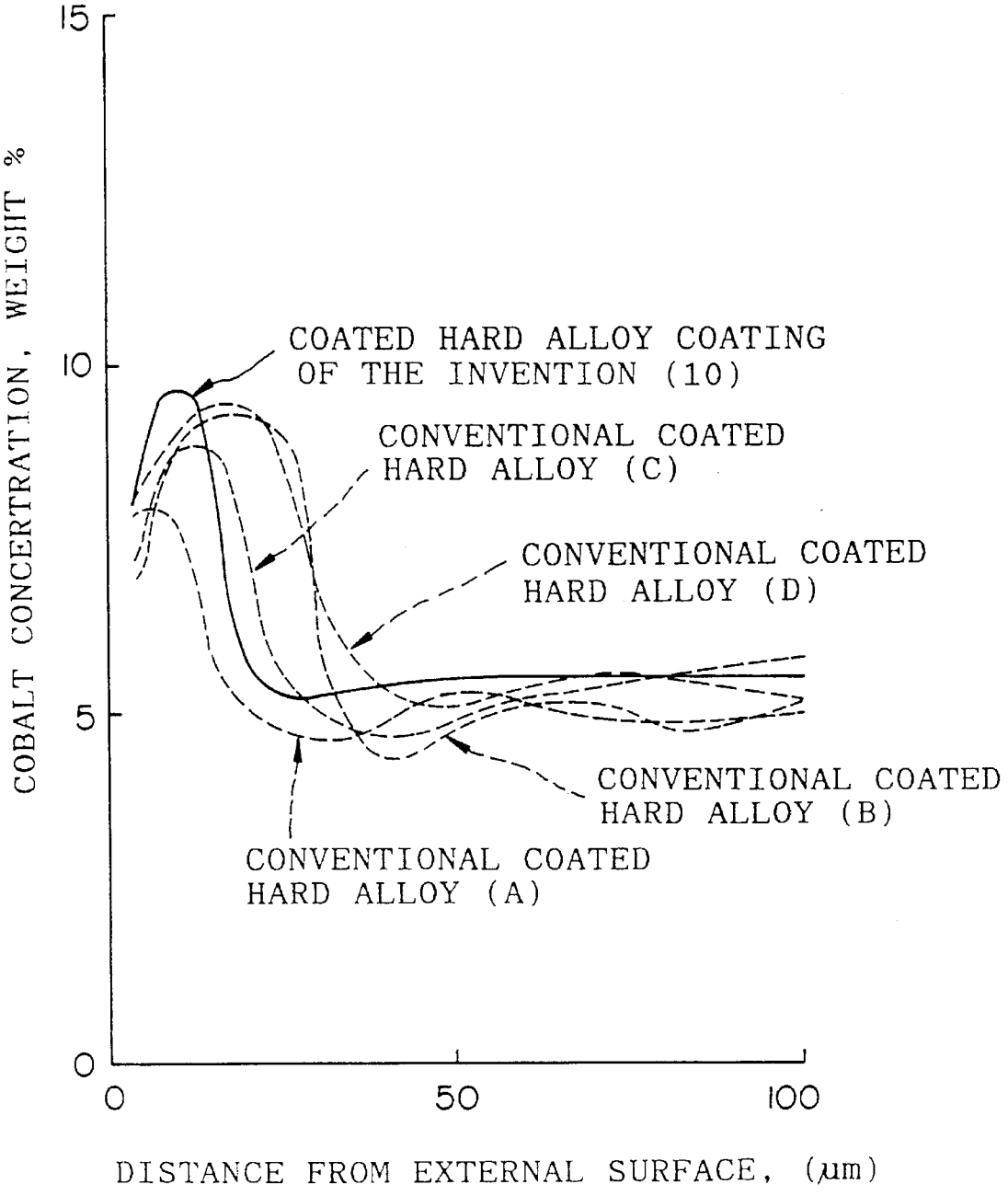
FIG. 7 shows a relationship between the Co concentration and the distance from the external surface of the substrate material in some samples.

The profiles of the concentration gradient of Co in the coated hard alloy insert samples are shown in FIG. 7. These results were obtained by energy dispersive X-ray spectroscopy in a 4×26 μm area under a scanning electron microscope at a magnification of 5,000. The measurements were repeated five times at a designated depth to obtain an average value.

In these sample, the denuded zone was 12 μm, and the residual stress values in the primary TiCN coating determined by a X-ray technique are as shown in Table 2.

A part of the coated samples was subjected to shot peening using 0.3 mm diameter steel shot at a speed of 50 m/s for 60 seconds, to produce the coated samples of the present invention shown in Table 2. The residual stresses in the TiCN coating were also measured, as reported in Table 2.

For comparative evaluation purposes, samples A and B shown in Table 2 were produced, in which sample A is similar to sample D in Example 3 of Japanese Patent Application, First Publication Showa54(1979)-Laid Open Publication No. 87719 containing no free carbon particles; and sample B is similar to sample F disclosed in the same example having 0.1% free carbon particles.

These comparative evaluation samples were produced by blending starting materials of powder particles of: WC-4%$(Ti_{0.75}W_{0.25})(C_{0.68}N_{0.32})$-5%$(Ta_{0.75}Nb_{0.25})$C-5.5% Co, with 0.16% and 0.26% graphite additions, and by pressing to produce green pressed compacts. They were sintered at 1450° C. for 1.5 hours in a vacuum of $10^{-3}$ torr to produce samples of substrate material having essentially no free carbon particles and samples having 0.1% free carbon particles.

These comparative samples were honed and coated with a combination coating of a TiC coating of 6 μm thickness and an $Al_2O_3$ coating of 1 μm thickness. The Co-enriched layers in these comparative samples are also shown in FIG. 7, and the thickness of the denuded zones was 11 μm in those samples containing no-free carbon particles, and 28 μm in those samples containing free-carbon particles.

Also for comparative purposes, coated hard alloy insert sample C was prepared in the same way as disclosed in Example 4 of U.S. Pat. No. 4,812,370 (Japanese Patent Application, First Publication Showa63(1988)-Laid Open Publication No. 89666).

This comparative evaluation sample was produced by mixing a starting material of powder particles: WC-5.9%$(Ti_{0.71}W_{0.29})(C_{0.69}N_{0.31})$-4%$(Ta_{0.83}Nb_{0.17})$C-6% Co, with 0.16% graphite, press compacted, and sintered at 1420° C. for 1.5 hours in a vacuum of $1\times10^{-3}$ torr to produce samples of a substrate material having essentially no free carbon particles.

The surface of the sample was honed, and a multi-layer coating consisting of TiC(1 μm)-TiCN(2 μm)-TiC(4 μm)-TiCNO(0.5 μm)-$Al_2O_3$ (1.5 μm) was deposited thereon. The thickness of the denuded zone in this sample was 12 μm, and the profiles of the Co in the Co-enriched layer was as shown in FIG. 7.

Also for comparative purposes, coated hard alloy insert sample D was prepared in the same way as disclosed in Example 1 of U.S. Pat. No. 4,497,874.

This comparative evaluation sample was produced by mixing a starting material of powder particles of: WC-5%$(W_{0.5}Ti_{0.5})$C-6% TaC-6% Co, press compacted, dewaxed and sintered at 1260° C. while flowing nitrogen at a rate of 3 L/min in a reduced pressure of 600 torr. After forty five minutes of heating, nitrogen was removed and sintering was performed at 1445° C. for 100 minutes in a reduced pressure argon atmosphere of 2 torr. The surfaces of the sample were honed as before, and a multilayer coating consisting of TiN(1.5 μm)-TiC(8 μm)-$Al_2O_3$ (2 μm).

The thickness of the denuded zone was 28 μm, and the presence of free-carbon particles were noted.

All of these comparative evaluation samples were subjected to X-ray residual stress determinations.

TABLE 1

| Coating | Gas Composition (volume %) | Reaction T (°C.) |
|---|---|---|
| TiCN (for primary coating) | $TiCl_4$: 1.5<br>$CH_3CN$: 0.5<br>$N_2$: 25<br>$H_2$: remainder | 860 |
| $Al_2O_3$ | $AlCl_3$: 5.0<br>$CO_2$: 8.0<br>$H_2$: remainder | 1020 |
| TiCN (for surface coating) | $TiCl_4$: 2<br>$CH_4$: 5<br>$N_2$: 20<br>$H_2$: remainder | 1020 |
| TiC | $TiCl_4$: 2<br>$CH_4$: 5<br>$H_2$: remainder | 1020 |
| TiN | $TiCl_4$: 2<br>$N_2$: 30<br>$H_2$: remainder | 1020 |
| TiCO | $TiCl_4$: 2<br>CO: 6<br>$H_2$: remainder | 1020 |
| TiCNO | $TiCl_4$: 2<br>CO: 3<br>$N_2$: 3<br>$H_2$: remainder | 1020 |

Next, machining test were carried out using the samples of the present invention as well as those of the comparative evaluation thus produced.

Continuous machining tests:

Material machined: a cylinder of JIS SCM440 ($H_B$ 200)

Machining speed: 250 m/min

Feed rate: 0.3 mm/rev.

Depth of Cut: 1.5 mm

Machining duration: 30 minutes

Lubricant: water soluble

Interrupted machining tests:

Material machined: a square cylinder of JIS SNCM439 ($H_B$ 270)

Machining speed: 100 m/min

Feed rate: 0.35 mm/rev.

Depth of Cut: 3.0 mm

Lubricant: none

In continuous machining, the wear of the rake surface was measured, and in interrupted machining, the resistance to chipping was evaluated by the time to first chipping.

TABLE 2

| Test No. | Coating | Peening | Residual Stress ($Kg/mm^2$) | Wear | Chipping |
|---|---|---|---|---|---|
| 1 | TiCN(8.5)-$Al_2O_3$(2)-TiN(1) | None | TiCN/23T | 0.24 | 13.1 |

TABLE 2-continued

| Test No. | Coating | Peening | Residual Stress ($Kg/mm^2$) | Wear | Chipping |
|---|---|---|---|---|---|
| 1' | TiCN(8.5)-$Al_2O_3$(2)-TiN(1) | All Surfaces | TiCN/9T | 0.26 | 16.1 |
| 1" | TiCN(8.5)-$Al_2O_3$(2)-TiN(1) | Rake Surface | TiCN rake/9T flank/23T | 0.24 | 10.2 |
| 2 | TiCN(5)-TiC(3.5)-$Al_2O_3$(2)-TiN(1) | None | TiCN/22T | 0.23 | 12.7 |
| 2' | TiCN(5)-TiC(3.5)-$Al_2O_3$(1)-TiN(1) | All Surfaces | TiCN/8T | 0.25 | 16.0 |
| 3 | TiCN(8.5)-TiCNO(0.3) $Al_2O_3$(2)-TiN(1) | None | TiCN/22T | 0.22 | 13.2 |
| 3' | TiCN(5)-TiC(3.5)-TiCNO(0.3)-$Al_2O_3$(2)-TiCN(1)-TiN(1) | Rake Surface | TiCN/ rake/6T flank/25T | 0.23 | 16.1 |
| 4 | TiCN(5)-TiC(3.5)-TiCO(0.3)-$Al_2O_3$(2)-TiN(1) | None | TiCN/24T | 0.22 | 13.0 |
| 5 | TiN(0.5)-TiCN(8.5)-$Al_2O_3$(2)-TiCN(1)-TiN(1) | None | TiCN/21T | 0.22 | 13.0 |
| 6 | TiN(0.5)-TiCN(5.0)-TiC(3.5)-$Al_2O_3$(2)-TiCN(1)-TiN(1) | None | TiCN/21T | 0.21 | 12.7 |
| 7 | TiN(0.5)-TiCN(8.5)-TiCNO(0.3)-$Al_2O_3$(2)-TiCN(1)-TiN(1) | None | TiCN/21T | 0.21 | 13.2 |
| 8 | TiN(0.5)-TiCN(5)-TiC(3.5)-TiCNO(0.3)-$Al_2O_3$(2)-TiCN(1)-TiN(1) | None | TiCN/20T | 0.20 | 12.8 |
| 9 | TiCN(8.5)-TiCNO(0.3)-$Al_2O_3$(2)-TiN(1) | All Surfaces | TiCN/4T | 0.24 | 16.8 |
| 10 | TiCN(8.5)-TiCNO(0.3)-$Al_2O_3$(2)-TiN(1) | Rake Surface | TiCN/ rake/4T flank/22T | 0.21 | 16.9 |
| 11 | TiCN(5)-TiC(3.5)-TiCO(0.3)-$Al_2O_3$(2)-TiN(1) | All Surfaces | TiCN/8T | 0.24 | 16.4 |
| 12 | TiCN(5)-TiC(3.5)-TiCO(0.3)-$Al_2O_3$(2)-TiN(1) | Rake Surface | TiCN/ rake/4T flank/24T | 0.21 | 16.3 |
| 13 | TiN(0.5)-TiCN(8.5)-TiCNO(0.3)-$Al_2O_3$(2)-TiCN(1)-TiN(1) | All Surfaces | TiCN/1C | 0.23 | 16.8 |
| 14 | TiN(0.5)-TiCN(8.5)-TiCNO(0.3)-$Al_2O_3$(2)-TiCN(1)-TiN(1) | Rake Surface | TiCN/ rake/1C flank/20T | 0.20 | 16.8 |
| 15 | TiN(0.5)-TiCN(5)-TiC(3.5)-TiCNO(0.3)-$Al_2O_3$(2)-TiCN(1)-TiN(1) | All Surfaces | TiCN/5T | 0.22 | 16.5 |
| 16 | TiN(0.5)-TiCN(5)-TiC(3.5)-TiCNO(0.3)-$Al_2O_3$(2)-TiCN(1)-TiN(1) | Rake Surface | TiCN/ rake/5T flank/22T | 0.20 | 16.5 |
| A | TiC(6.0)-$Al_2O_3$(1) | None | TiC/38T | 0.48 in 15 min | 4.1 |
| B | TiC(6.0)-$Al_2O_3$(1) | None | TiC/35T | 0.59 in 10 min | 6.2 |
| C | TiC(1)-TiCN(2)-TiC(4)-TiCNO(0.5)-$Al_2O_3$(1.5)- | None | TiC/36T | 0.45 in 20 min | 5.3 |
| D | TiN(1.5)-TiC(8)-$Al_2O_3$(2) | None | TiC/32T | 0.55 in 15 min | 6.0 |

Notes:
In Table 2, various abbreviations are as follows:
TiCN(8.5): indicates a TiCN coating of 8.5 μm thickness.
TiCN/22T: indicates a tensile residual stress value of 22 $Kg/mm^2$ measured on a TiCN surface.
TiCN/ indicates residual stress values of 4
rake/4T $Kg/mm^2$ measured on a rake surface,
flank/22T: and 22 $kg/mm^2$ measured on flank surfaces of TiCN coating.

The results shown in Table 2 demonstrate clearly that the coated hard alloy insert according to the present invention are far superior to those made by the existing methods. The performance parameters, wear resistance and chipping tendencies are much improved over the conventionally prepared cutting tools.

The coated cutting tool of the present invention is characterized by a Co concentration gradient in the Co-enriched surface layer such that the maximum Co concentration occurs in a region up to 50 μm depth. The Co concentration at the surface is lower than the maximum value, and strong bonding between the surface layer and the coating is ensured by developing a microstructure so that the surface layer is free of the B-1 type hard phases.

The primary coating on the invented cutting tool is TiCN, and is made by reacting titanium tetrachloride with acetonitrile at relatively low temperatures of 840°–900° C., compared with the conventional technique of 1000°–1050° C. Therefore, there is less diffusion of the constituting elements of the substrate material, such as WC and Co, into the coating, and there is less tendency to form detrimental microstructural phases, such as pores and the brittle phases (an eta phase), thereby improving the bonding of the primary coating TiCN to the substrate material.

The technique of depositing a coating on a substrate material with the use of $TiCl_4$ and acetonitrile is disclosed as an example in Japanese Patent Application, First Publication Showa50(1975)-117809, but the substrate material has a composition, WC-22%(TiC+TaC)-9.5% Co, but has neither a Co-enriched surface nor a denuded zone free of the B-1 type hard phases, and is a typical conventional material which did not come into general use.

The present coatings, composed of primarily TiCN, are far superior to such materials because they are produced at relatively low deposition temperatures, and are deposited on a substrate material having a Co-enriched surface layer having a maximum value of Co within a 50 μm of the external surface, and are supplemented with a secondary coating of $Al_2O_3$, and the surface coatings of one of TiN and TiCN.

Second Preferred Embodiment

A second embodiment of the invention will be described in the following.

The same starting powder materials as the first embodiment were blended to prepare a mixture of a composition represented by: WC-4.6%$(Ti_{0.71}W_{0.29})$ $(C_{0.68}N_{0.32})$-3.5%$(Ta_{0.83}Nb_{0.17})$C-8% Co. The mixture was blended further with 0.16% graphite powder to produce a first group of samples, and with 0.26% graphite powder to prepare a second group of samples, and the entire mixture was wet-milled for 72 hours in a ball-mill, and dried. Green pressed compacts were made in accordance with ISO CNMG120408 using a press at 15 Kg/mm$^2$. The green compacts were sintered in a vacuum of $1\times10^{-2}$ torr at 1380° C. for one hour. Two groups of samples of hard alloy substrate materials, a group which is essentially free of free carbon particles, and a group which contains overall free graphite particles of 0.1% and which is has a denuded zone of 350 μm depth which is basically free of free carbon particles when viewed under optical microscope.

These sintered substrate material samples were treated by honing, and coatings were deposited thereon, shot peened using the same procedure as the first embodiment, to produce cutting insert samples 17 to 28 shown in Table 3. It should be noted that the sample group having 0.16% added graphite exhibited no free carbon particles while the sample group having 0.26% added graphite exhibited free carbon particles. The Co distribution patterns in these samples are reported in FIG. 8.

The thickness of the denuded zones in the samples having no free carbon particles was 13 μm, and 21 μm in the samples having free carbon particles.

For comparative evaluation purposes, samples E, shown in Table 3 were produced, according to the process disclosed in U.S. Pat. No. 4,277,283 (Japanese Patent Application, First Publication Showa54(1979)-Laid Open Publication No. 87719).

These comparative evaluation samples were produced by blending starting materials of powder particles of: WC-6.3%$(Ti_{0.75}W_{0.25})(C_{0.68}N_{0.32})$-7.5%$(Ta_{0.75}Nb_{0.25})$C-10.5% Co, with 0.16% graphite, and by pressing the powder to produce green pressed compacts. They were sintered at 1380° C. for 1.5 hours in a vacuum of $1\times10^{-3}$ torr to produce samples of a substrate material having essentially no free carbon particles. The samples were treated by honing, and TiC coating of 6 μm thickness was deposited thereon using the same procedure as the first embodiment to produce comparative evaluation sample E.

Figure 8:
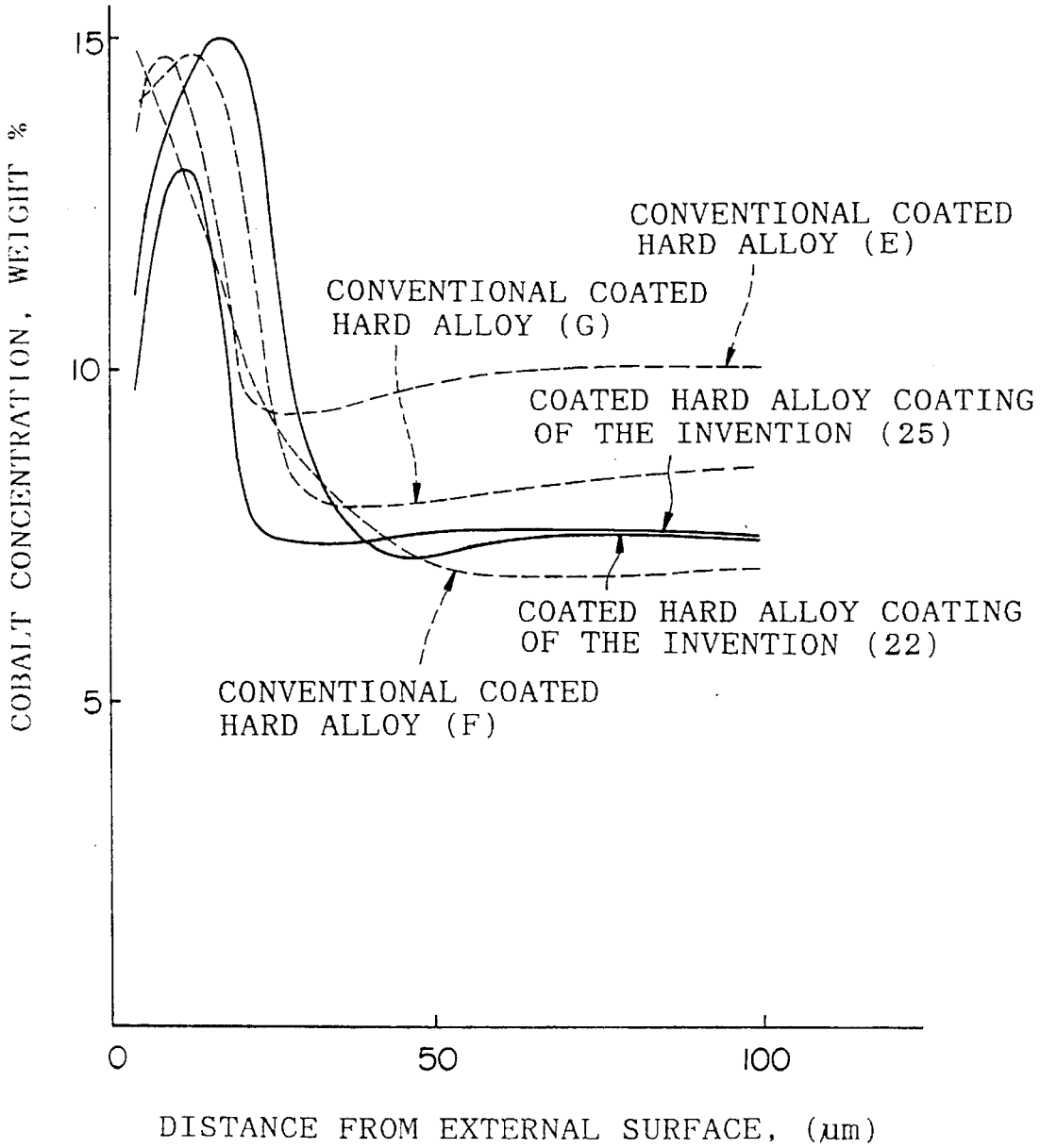
FIG. 8 shows a relationship between the Co concentration and the distance from the external surface of the substrate material in other samples.

The profiles of Co distribution in the surface layer of the substrate material were as shown in FIG. 8, and the thickness of the denuded zone was 10 μm.

Further comparative evaluation samples were produced according to the first embodiment disclosed in Japanese Patent Application, First Publication Showa63(1988)-Laid Open Publication No. 169356.

The substrate material of this disclosed embodiment was WC-5% TiC-7% Co, and after blending the materials and pressing to produce green pressed compacts, they were sintered at 1380° C. for 1 hour in a vacuum. They were carburized in a gas mixture of $H_2$(80%)-$CH_4$(20%) at a reduced pressure of 20 torr for 10 minutes, after which they were decarburized at 1310° C. for 2 minutes in a gas mixture of $H_2$(90%)-$CO_2$(10%), and cooled to room temperature in a vacuum.

The substrate material thus produced was treated by honing and TiC coating was deposited by the same procedure as in the first embodiment to produce sample F having a 5 μm thick coating of TiC. The profile of the Co distribution was as shown in FIG. 8, and there was no denuded zone, i.e. the B-1 type hard phase was present in the surface layer.

Further comparative evaluation sample G was produced in accordance with the first embodiment in the U.S. Pat. No. 4,610,931.

The substrate material of this disclosed embodiment was WC-10.3 TaC-5.85% TiC-0.2% NbC-1.5% TiN-8.5% Co, to which 0.1% graphite powder was added, and after blending the materials and pressing to produce green pressed compacts, they were sintered at 1496° C. for 30 minutes in a vacuum. After which, only the rake surfaces (top and bottom surfaces) were ground, and the sample was vacuum heated at 1427° C. for 1 hour in a vacuum of 100 torr, and was cooled at a rate of 56° C./min to 1204° C., and cooled to room temperature in a vacuum. The flank surfaces were then ground, and a CVD coating TiC(5 μm)/TiCN(4 μm)/TiN (1 μm) was deposited thereon (Sample G). The profile of the Co distribution is as shown in FIG. 8, and the thickness of the denuded zone was 20 μm.

Next, machining test were carried out using the samples of the present invention as well as those of the comparative evaluation produced above.

Continuous machining tests:

Material machined: a cylinder of JIS SCM440 ($H_B$ 200)

Machining speed: 180 m/min

Feed rate: 0.35 mm/rev.

Depth of Cut: 2.0 mm

Machining duration: 30 minutes

Lubricant: water soluble

Interrupted machining tests:

Material machined: a square cylinder of JIS SNCM439 ($H_B$ 270)

Machining speed: 100 m/min

Feed rate: 0.3 mm/rev.

Depth of Cut: 2.5 mm

Lubricant: none

In continuous machining, the wear of the rake surface was measured, and in interrupted machining, the resistance to chipping was evaluated by the time to the occurrence of first chipping event.

TABLE 3

| Test No. | Coating | Peening | Residual Stress ($Kg/mm^2$) | Wear Width (mm) | Chipping Time (min) |
|---|---|---|---|---|---|
| 17 | TiCN(9.5)-$Al_2O_3$(1.5)-TiN(1) | None | TiCN/20T | 0.29 | 14.6 |
| 18 | TiCN(9.5)-$Al_2O_3$(1.5)-TiCN(1)-TiN(1) | All Surfaces | TiCN/9T | 0.29 | 18.5 |
| 19 | TiCN(9)-TiCNO(0.3)-$Al_2O_3$(1.5)-TiCN(1)-TiN(1) | Rake Surface | TiCN/ rake/8T flank/20T | 0.28 | 18.8 |
| 20 | TiN(0.5)-TiCN(9)-TiCNO(0.3) $Al_2O_3$(1.5)-TiCN(1)-TiN(1) | None | TiCN/18T | 0.27 | 14.4 |
| 21 | TiN(0.5)-TiCN(9)-TiCNO(0.3) $Al_2O_3$(1.5)-TiCN(1)-TiN(1) | All Surfaces | TiCN/1C | 0.28 | 18.9 |
| 22 | TiN(0.5)-TiCN(9)-TiCNO(0.3) $Al_2O_3$(1.5)-TiCN(1)-TiN(1) | Rake Surface | TiCN/18T rake/1C flank/17T | 0.27 | 18.9 |
| 23 | TiCN(9.5)-$Al_2O_3$(1.5)-TiN(1) | None | TiCN/22T | 0.26 | 13.5 |
| 24 | TiCN(9.5)-$Al_2O_3$(1.5)-TiCN(1)-TiN(1) | All Surfaces | TiCN/8T | 0.27 | 17.0 |
| 25 | TiCN(9)-TiCNO(0.3)-$Al_2O_3$(1.5)-TiCN(1)-TiN(1) | Rake Surface | TiCN/ rake/7T flank/21T | 0.23 | 13.0 |
| 26 | TiN(0.5)-TiCN(9)-TiCNO(0.3) $Al_2O_3$(1.5)-TiCN(1)-TiN(1) | None | TiCN/20T | 0.23 | 13.0 |
| 27 | TiN(0.5)-TiCN(9)-TiCNO(0.3) $Al_2O_3$(1.5)-TiCN(1)-TiN(1) | All Surfaces | TiCN/7C | 0.24 | 17.0 |
| 28 | TiN(0.5)-TiCN(9)-TiCNO(0.3) $Al_2O_3$(1.5)-TiCN(1)-TiN(1) | Rake Surface | TiCN/18T rake/1C flank/19T | 0.22 | 17.2 |
| E | TiC(6) | None | TiC/35T | 0.60 in 12 min | 6.2 |
| F | TiC(5) | None | TiC/33T | 0.60 in 15 min | 8.5 |
| G | TiC(5)-TiCN(3.9)-TiN(1) | None | TiC/30T | 0.57 in 15 min | 7.9 |

Notes on Table 3:
Samples 17 to 22 inclusively have free carbon particles:
Samples 23 to 28 inclusively have no free carbon particles:
Comparative Evaluation Sample E & G have no free carbon particles:

TABLE 3-continued

Comparative Evaluation Sample F has free carbon particles.
Other abbreviations are as noted for Table 2.

It is known generally that in forming deposits by thin film forming techniques, such as CVD, residual tensile stresses are generated in the coating (TIC) because of the differences in thermal coefficient of expansion between the coating layer and substrate material. The values of such residual stresses differ among the coatings, depending on the coating thickness and the composition of both coatings and substrate materials. In the substrate material containing less than 10% Co, the residual tensile stresses in a range of 30 to 60 $Kg/mm^2$ are reported to be present (Journal of the Japan Institute of Metals, v. 50, No. 3, pp 320–327, 1986).

In the Tables 2 and 3, it can be seen that the tensile residual stresses of the conventional materials all exceed 30 $Kg/mm^2$. However, it was found in the present invention that, by means of shot peening, residual stresses can be decreased, and by selecting the peening conditions, tensile stresses in the deposited coatings can be converted to compressive residual stresses.

What is claimed is:

1. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(a) a primary layer comprising a TiCN layer;

(b) a secondary layer comprising an $Al_2O_3$ layer; and (c) a surface layer comprising at least one layer selected from the group consisting of a TiCN layer and a TiN layer;

wherein said primary layer is produced so that tensile residual stresses therein are not more than 30 $Kg/mm^2$; and wherein said layers (a)–(c) are deposited by chemical vapor deposition.

2. A coated hard alloy cutting tool as claimed in claim 1, wherein said substrate is substantially free of free carbon particles.

3. A coated hard alloy cutting tool as claimed in claim 1, wherein a surface region bounded by a distance of 100 μm to a distance of 400 μm from said external surface is substantially free of free carbon particles, while free carbon particles are present in a region located beyond about 400 μm from said external surface of said substrate.

4. A coated hard alloy cutting tool as claimed in claim 1, wherein said substrate is provided with rake surfaces and flank surfaces, wherein the tensile residual stresses in said primary layer on said rake surfaces are not greater than tensile residual stresses in said primary layer on said flank surfaces.

5. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(a) a primary layer comprising a TiCN layer;

(b) a secondary layer comprising an $Al_2O_3$ layer; and (c) a surface layer comprising at least one layer selected from the group consisting of a TiCN layer and a TiN layer;

wherein said substrate is provided with rake surfaces and flank surfaces;

wherein said primary layer on said rake surfaces is treated to produce compressive residual stresses therein of not more than 20 $Kg/mm^2$;

wherein said primary layer on said flank surfaces is produced so that tensile residual stresses therein are not more than 30 $Kg/mm^2$; and wherein said layers (a)–(c) are deposited by chemical vapor deposition.

6. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and a least one coating deposited on said surface of said substrate, said coating, sequentially consists of:

(d) a first intermediate layer comprising a TiN layer;

(a) a primary layer comprising a TiCN layer;

(b) a secondary layer comprising an $Al_2O_3$ layer; and (c) a surface layer comprising at least one layer selected from the group consisting of a TiCN layer and a TiN layer;

wherein said primary layer is produced so that tensile residual stresses therein are not more than 30 $kg/mm^2$; and wherein said layers (a)–(d) are deposited by chemical vapor deposition.

7. A coated hard alloy cutting tool as claimed in claim 6, wherein the thickness of said first intermediate layer is not more than 1 μm.

8. A coated hard alloy cutting tool as claimed in claim 6, wherein said substrate is substantially free of free carbon particles.

9. A coated hard alloy cutting tool as claimed in claim 6, wherein a surface region bounded by a distance of 100 μm to a distance of 400 μm from said external surface is substantially free of free carbon particles, while free carbon particles are present in a region located beyond about 400 μm from said external surface of said substrate.

10. A coated hard alloy cutting tool as claimed in claim 6, wherein said substrate is provided with rake surfaces and flank surfaces, wherein the tensile residual stresses in said primary layer on said rake surfaces are not greater than tensile residual stresses in said primary layer on said flank surfaces.

11. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(d) a first intermediate layer comprising a TiN layer;

(a) a primary layer comprising a TiCN layer;

(b) a secondary layer comprising an $Al_2O_3$ layer; and (c) a surface layer comprising at least one layer selected from the group consisting of a TiCN layer and a TiN layer;

wherein said substrate is provided with rake surfaces and flank surfaces;

wherein said primary layer on said rake surfaces is treated to produce compressive residual stresses therein of not more than 20 $Kg/mm^2$;

wherein said primary layer on said flank surfaces is produced so that tensile residual stresses therein are not more than 30 $Kg/mm^2$; and wherein said layers (a)–(d) are deposited by chemical vapor deposition.

12. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(a) a primary layer comprising a TiCN layer;

(e) a second intermediate layer comprising at least one layer selected from the group comprising a TiC layer, a TiCO layer and a TiCNO layer;

(b) a secondary layer comprising an $Al_2O_3$ layer; and (c) a surface layer comprising at least one layer selected from the group consisting of a TiCN layer and a TiN layer; wherein said primary layer is produced so that tensile residual stresses therein are not more than 30 $kg/mm^2$; and wherein said layers (a)–(c) and (e) are deposited by chemical vapor deposition.

13. A coated hard alloy cutting tool as claimed in claim 12, wherein the total thickness for said second intermediate layer of a TiCO layer and a TiCNO layer is not more than 1 μm.

14. A coated hard alloy cutting tool as claimed in claim 12, wherein said substrate is substantially free of free carbon particles.

15. A coated hard alloy cutting tool as claimed in claim 12, wherein a surface region bounded by a distance of 100 μm to a distance of 400 μm from said external surface is substantially free of free carbon particles, said free carbon particles being present in a region of said substrate located beyond about 400 μm from said external surface of said substrate.

16. A coated hard alloy cutting tool as claimed in claim 12, wherein said substrate is provided with rake surfaces and flank surfaces, wherein the tensile residual stresses in said primary layer on said rake surfaces are not greater than tensile residual stresses in said primary layer on said flank surfaces.

17. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(a) a primary layer comprising a TiCN layer;

(e) a second intermediate layer comprising at least one layer selected from the group comprising a TiC layer, a TiCO layer and a TiCNO layer;

(b) a secondary layer comprising an $Al_2O_3$ layer; and (c) a surface layer comprising at least one layer selected from the group consisting of a TiCN layer and a TiN layer;

wherein said substrate is provided with rake surfaces and flank surfaces;

wherein said primary layer on said rake surfaces is treated to produce compressive residual stresses therein of not more than 20 $Kg/mm^2$;

wherein said primary layer on said flank surfaces is produced so that tensile residual stresses therein are not more than 30 $kg/mm^2$; and wherein said layers (a)–(c) and (e) are deposited by chemical vapor deposition.

18. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(d) a first intermediate layer comprising a TiN layer;

(a) a primary layer comprising a TiCN layer;

(e) a second intermediate layer comprising at least one layer selected from the group comprising a TiC layer, a TiCO layer and a TiCNO layer;

(b) a secondary layer comprising an $Al_2O_3$ layer; and (c) a surface layer comprising at least one layer selected from the group consisting of a TiCN layer and a TiN layer; wherein said primary layer is produced so that tensile residual stresses therein are not more than 30 $Kg/mm^2$; and wherein said layers (a)–(e) are deposited by chemical vapor deposition.

19. A coated hard alloy cutting tool as claimed in claim 18, wherein the thickness of said first intermediate layer of TiN layer is not more than 1 μm.

20. A coated hard alloy cutting tool as claimed in claim 18, wherein the total thickness of said second intermediate layer of a TiCO layer or a TiCNO layer is not more than 1 μm.

21. A coated hard alloy cutting tool as claimed in claim 18, wherein said substrate is substantially free of free carbon particles.

22. A coated hard alloy cutting tool as claimed in claim 18, wherein a surface region bounded by a distance of 100 μm to a distance of 400 μm from said external surface is substantially free of free carbon particles, said free carbon particles being present in a region located beyond about 400 μm from said external surface of said substrate.

23. A coated hard alloy cutting tool as claimed in claim 18, wherein said substrate is provided with rake surfaces and flank surfaces, wherein tensile residual stresses in said primary layer on said rake surfaces are not greater than tensile residual stresses in said primary layer on said flank surfaces.

24. A coated hard alloy cutting tool, comprising:

a substrate comprising WC and Co, wherein the maximum concentration of Co occurs in a surface layer region of 50 μm from the external surface of said substrate, said maximum concentration is less than 15 wt %, said surface layer region is substantially free of the carbides of Ti, Ta and Nb containing W; the carbonitrides of Ti, Ta and Nb containing W; and the nitrides of Ti, Ta and Nb containing W; and at least one coating deposited on said surface of said substrate, said coating, sequentially consists of:

(d) a first intermediate layer comprising a TiN layer;

(a) a primary layer comprising a TiCN layer;

(e) a second intermediate layer comprising at least one layer selected from the group consisting of a TiC layer, a TiCO layer and a TiCNO layer;

(b) a secondary layer comprising an $Al_2O_3$ layer; and (c) a surface layer comprising at least one layer selected from the group consisting of a TiCN layer and a TiN layer;

wherein said substrate is provided with rake surfaces and flank surfaces;

wherein said primary layer on said rake surfaces is treated to produce compressive residual stresses therein of not more than 20 $Kg/mm^2$;

wherein said primary layer on said flank surfaces is produced so that tensile residual stresses therein are not more than 30 $kg/mm^2$; and wherein said layers (a)–(e) are deposited by chemical vapor deposition.

25. A coated hard alloy cutting tool as claimed in claim 1, wherein said primary layer is deposited at a temperature of 840°–900° C.

26. A coated hard alloy cutting tool as claimed in claim 5, wherein said primary layer is deposited at a temperature of 840°–900° C.

27. A coated hard alloy cutting tool as claimed in claim 6, wherein said primary layer is deposited at a temperature of 840°–900° C.

28. A coated hard alloy cutting tool as claimed in claim 11, wherein said primary layer is deposited at a temperature of 840°–900° C.

29. A coated hard alloy cutting tool as claimed in claim 12, wherein said primary layer is deposited at a temperature of 840°–900° C.

30. A coated hard alloy cutting tool as claimed in claim 17, wherein said primary layer is deposited at a temperature of 840°–900° C.

31. A coated hard alloy cutting tool as claimed in claim 18, wherein said primary layer is deposited at a temperature of 840°–900° C.

32. A coated hard alloy cutting tool as claimed in claim 24, wherein said primary layer is deposited at a temperature of 840°–900° C.

33. A coated hard alloy cutting tool as claimed in claim 1, wherein said primary layer is deposited by reacting a mixture comprising titanium tetrachloride and acetonitrile.

34. A coated hard alloy cutting tool as claimed in claim 5, wherein said primary layer is deposited by reacting a mixture comprising titanium tetrachloride and acetonitrile.

35. A coated hard alloy cutting tool as claimed in claim 6, wherein said primary layer is deposited by reacting a mixture comprising titanium tetrachloride and acetonitrile.

36. A coated hard alloy cutting tool as claimed in claim 11, wherein said primary layer is deposited by reacting a mixture comprising titanium tetrachloride and acetonitrile.

37. A coated hard alloy cutting tool as claimed in claim 12, wherein said primary layer is deposited by reacting a mixture comprising titanium tetrachloride and acetonitrile.

38. A coated hard alloy cutting tool as claimed in claim 17, wherein said primary layer is deposited by reacting a mixture comprising titanium tetrachloride and acetonitrile.

39. A coated hard alloy cutting tool as claimed in claim 18, wherein said primary layer is deposited by reacting a mixture comprising titanium tetrachloride and acetonitrile.

40. A coated hard alloy cutting tool as claimed in claim 24, wherein said primary layer is deposited by reacting a mixture comprising titanium tetrachloride and acetonitrile.

* * * * *